US005685029A

United States Patent [19]

Gee

[11] Patent Number: 5,685,029

[45] Date of Patent: Nov. 11, 1997

[54] POTTY TRAINING DEVICE

[76] Inventor: Duane Gee, 94-1485 Waipio Uka St., unit D203, Waipahu, Hi. 96797

[21] Appl. No.: 554,253

[22] Filed: Nov. 6, 1995

[51] Int. Cl.[6] ..... A47K 11/04

[52] U.S. Cl. ..... 4/483; 4/239; 4/902

[58] Field of Search ..... 4/237, 239, 483, 4/661, 902

[56] References Cited

U.S. PATENT DOCUMENTS 2,662,229 12/1953 Wenkstern ..... 4/239 X
2,667,802 2/1954 Harris ..... 4/239 X
3,343,179 9/1967 Sellars, Jr. et al. ..... 4/239 X
3,364,478 1/1968 Dee Waard ..... 4/902
3,982,288 9/1976 Borne ..... 4/237
4,883,749 11/1989 Roberts ..... 4/902

*Primary Examiner*—Robert M. Fetsuga
*Attorney, Agent, or Firm*—Michael I. Kroll

[57] ABSTRACT

A potty training device which comprises a potty toilet so constructed that it can be positioned upon a toilet seat on a bowl of a standard toilet. A potty seat is horizontally disposed on the potty toilet. A facility in the potty toilet is for illuminating the potty seat, when a toddler sits upon the potty seat. An assemblage in the potty toilet is for producing musical sounds, when the toddler sits upon the potty seat.

18 Claims, 3 Drawing Sheets

POTTY TRAINING DEVICE

BACKGROUND OF THE INVENTION

1. Field of the Invention

The instant invention relates generally to toddler commodes and more specifically it relates to a potty training device.

2. Description of the Prior Art

Numerous toddler commodes have been provided in prior art. For example, U.S. Pat. Nos. 2,766,716 to Mackey; 4,174,544 to Furusawa; 5,123,130 to Sanders and 5,369,820 to Blount all are illustrative of such prior art. While these units may be suitable for the particular purpose to which they address, they would not be as suitable for the purposes of the present invention as heretofore described.

An toddler's toilet training device adapted to be disposed in a toilet bowl. The device includes a receptacle adapted to receive excrement. The receptacle bottom is sloped downwardly toward one side thereof. Housing means is sealingly connected with the receptacle. A noise-making mechanism is within the housing means and includes a rotatably driven element. A stop member is supported in the housing means and is movable between a first position wherein the member engages the mechanism and prevents rotation of the element and a second position wherein the member moves out of engagement with the mechanism and permits rotation of the element. A weighted ball member is movably supported in the housing means for movement between a first position in which the weighted ball engages the stop member to retain the same in its first position when the receptacle is in a generally horizontal untilted position and a second position wherein the weighted ball member moves out of engagement with the stop member, so that the stop member moves to its second position when the receptacle is tilted. Means connected with the receptacle and engageable with a bowl is to normally retain the receptacle in a generally horizontal untilted position, but permits the receptacle to tilt when excrement engages the downwardly sloped bottom portion of the receptacle.

An organization is set forth including a series of components including a ring member for securement to and about a commode seat, a frame member for adherably mounting about a tissue roll dispenser, and a plurality of elongate longitudinally aligned mat members of flexible construction. The components include illumination with characteristics, to provide directional training to a child and the like for proper use of a commode during limited light conditions. The organization may include luminescent layers to provide visual observation to the components or alternatively utilize a fiber optic cable network directed therethrough, to provide continuous, as well as selective, illumination of the components.

An infant training stool having a bed pan rockably carried therein. A music box is mounted in the base portion of the stool and is normally kept from playing by a biased stopper rod blocking the governor. In a first embodiment, the weight of the infant lowers the stopper rod allowing the music box to play. In the second, the weight of the infant's illumination lowers the internal bed pan lowering the stopper rod thereby allowing the music box to play.

The present invention comprises a potty seat configured with a hinged platform ring upon which a toilet training child is to sit. A collecting basin is able to fit within a substantially hollow base of the potty seat. A pair of laterally disposed arms are provided. A simulative tank is connected between the arms toward the rear. A first pair of lights is recessed within the arms of the potty seat. A second light or pair of lights is recessed within the tank portion. A pair of serially connected switches are mounted respectively beneath the platform ring and beneath the collecting basin, so as to be close when a weight is pressed down on each switch and thus electrically connected to activate the first pair of lights. Another switch is connected to a simulated flush handle and, when pivoted by the user, activates the second light or lights. Thus, the lighting acts to positively respond to the child user carrying on the desired acts and learning proper toilet use.

SUMMARY OF THE INVENTION

A primary object of the present invention is to provide a potty training device that will overcome the shortcomings of the prior art devices.

Another object is to provide a potty training device that combines an illuminated potty seat with a musical response that is weight activated, when a toddler sits upon the potty seat.

An additional object is to provide a potty training device that is constructed so it can be positioned onto a toilet seat on a bowl of a standard toilet or can stand alone upon a floor to be utilized by the toddler.

A further object is to provide a potty training device that is simple and easy to use.

A still further object is to provide a potty draining device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF TEE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
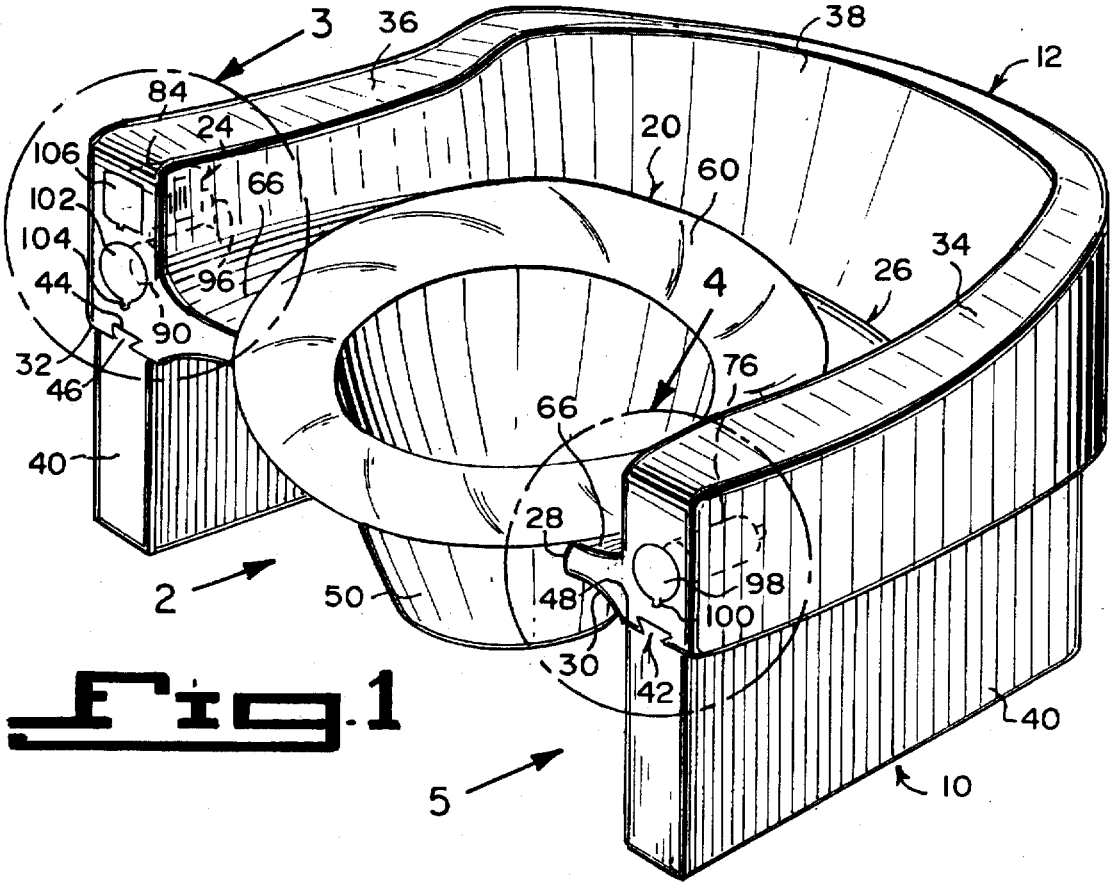
FIG. 1 is a perspective view of the instant invention.
Figure 2:
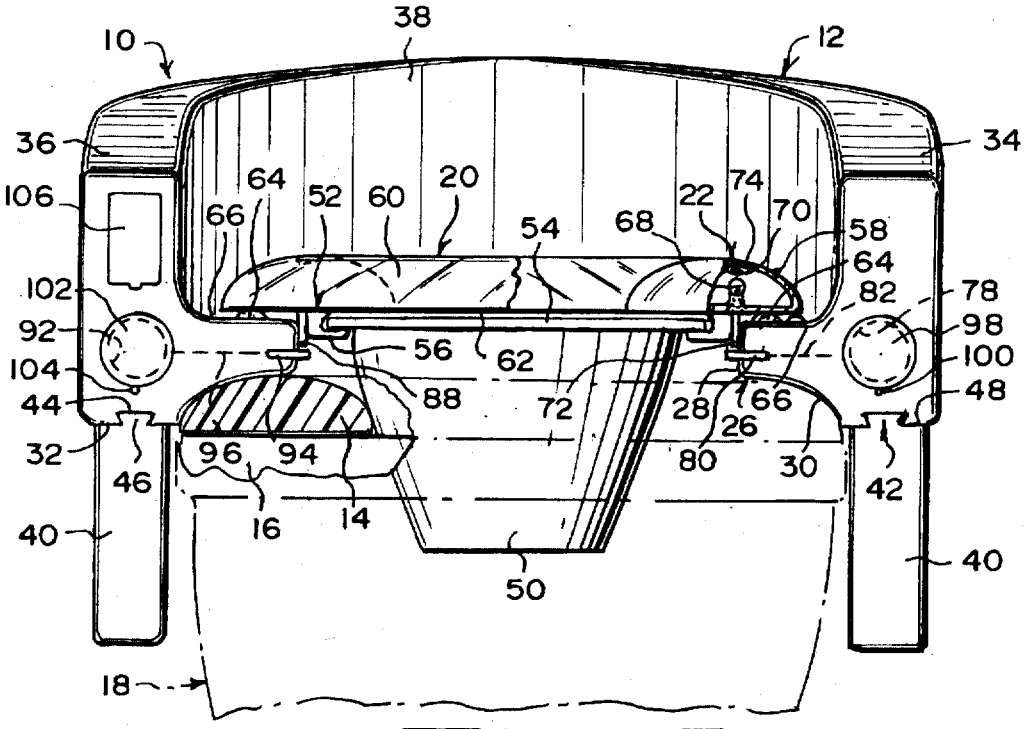
FIG. 2 is a front view taken in the direction of arrow 2 in FIG. 1, with parts broken away and in section.
Figure 3:
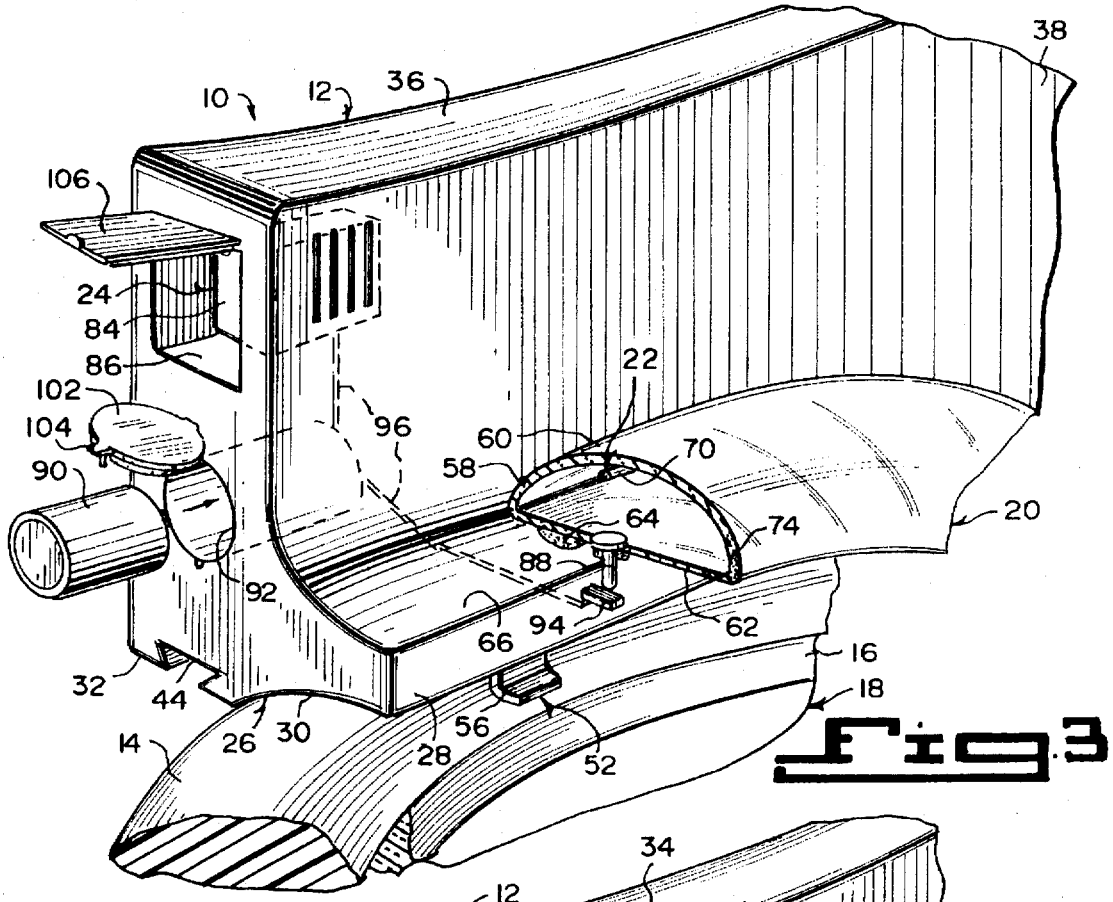
FIG. 3 is an enlarged perspective view of an area as indicated by arrow 3 in FIG. 1, with parts broken away and in section, showing the musical components therein.
Figure 4:
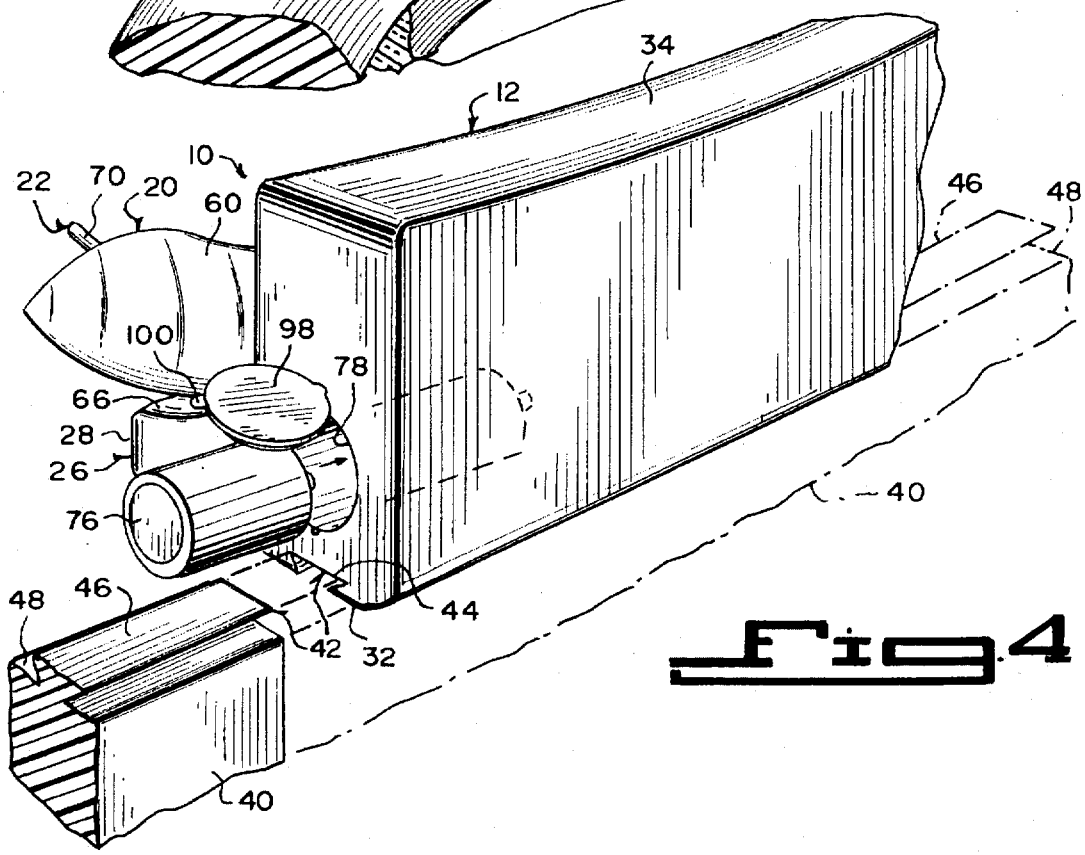
FIG. 4 is an enlarged perspective view of an area as indicated by arrow 4 in FIG. 1 with parts broken away and in section, showing the illumination components therein.
Figure 5:
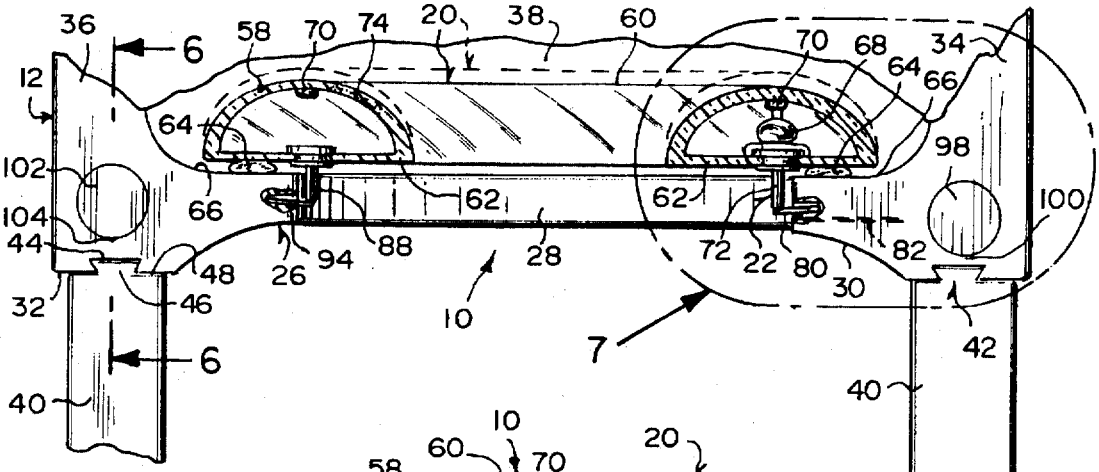
FIG. 5 is an enlarged front view with parts broken away and in section, taken in the direction of arrow 5 in FIG. 1.
Figure 6:
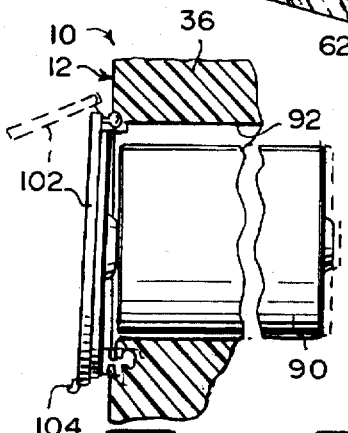
FIG. 6 is a cross sectional view taken along line 6—6 in FIG. 5, through one of the battery compartments with parts broken away.
Figure 7:
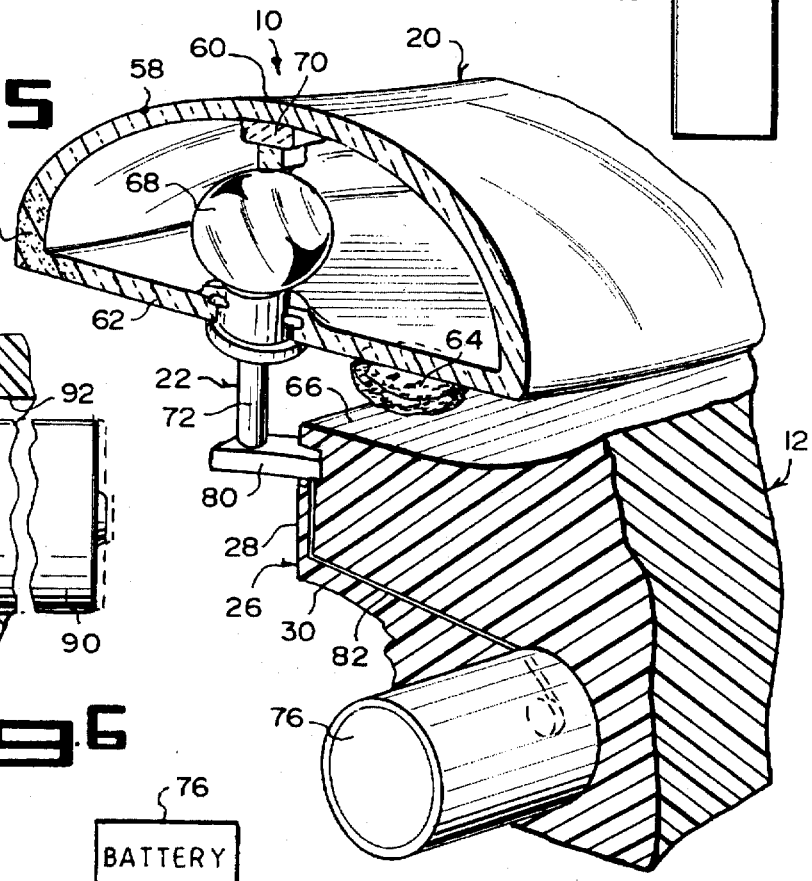
FIG. 7 is a further enlarged cross sectional perspective view of an area as indicated by arrow 7 in FIG. 5.
Figure 8:
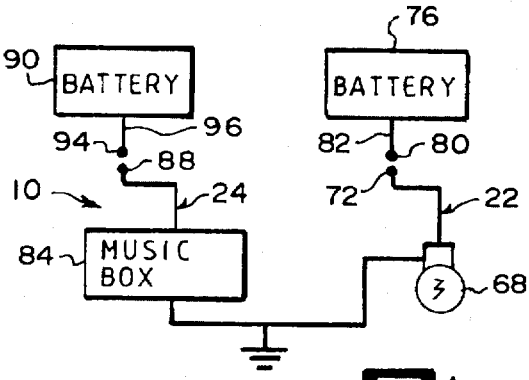
FIG. 8 is a block diagram of the electrical components of the instant invention.

Turning now descriptively to the drawings, in which similar reference characters denote similar elements throughout the several views, FIGS. 1 through 8 illustrate a potty training device 10, which comprises a potty toilet 12 so constructed that it can be positioned upon a toilet seat 14 on a bowl 16 of a standard toilet 18. A potty seat 20 is horizontally disposed on the potty toilet 12. A facility 22 in the potty toilet 12, is for illuminating the potty seat 20, when an toddler sits upon the potty seat 20. An assemblage 24 in the potty toilet 12, is for producing musical sounds, when the toddler sits upon the potty seat 20.

The potty toilet 12 includes a base 26 having a horizontally disposed opening 28 and a convex portion 30 on a bottom surface 32 about the opening 28. The convex portion 30 of the base 26 can snugly fit upon the toilet seat 14, with the potty seat 20 placed on the base 26. A pair of upright armrest 34, 36 are located on opposite sides of the potty seat 20 and are supported by the base 26. An upright low backrest 38 extends between the armrest 34, 36. The base 26, the armrest 34, 36 and the low backrest 38 are integral, so as to form one complete unit.

The potty toilet 12 further includes a pair of side legs 40. Components 42 are for attaching the side legs 40 in a removable manner to the bottom surface 32 of the base 26 on opposite sides of the opening 28, so that the potty toilet 12 can stand alone upon a floor. The attaching components 42 consist of the bottom surface 32 of the base 26 having a pair of grooves 44 formed on opposite sides of the opening 28. The side legs 40 each have a tongue 46, formed on a top surface 48. Each tongue 46 can longitudinally slide into each groove 44.

The potty toilet 12 further contains a collection basin 50. A structure 52 is for connecting the collection basin 50 in a removable manner to an underside of the potty seat 20. When the potty seat 20 is in place on the base 26, the toddler sitting upon the potty seat 20 can deposit excrement into the collection basin 50.

The connecting structure 52 consists of the collection basin 50 having an annular top lip 54 thereabout. A pair of L-shaped brackets 56 are affixed to opposite sides at the underside of the potty seat 20, to engage with the annular top lip 54 of the collection basin 50.

The illuminating facility 22 includes the potty seat 20 being hollow, fabricated out of a transparent material 58 and has a convex top wall 60 and a flat bottom wall 62. A compressible resilient pad 64 is mounted to the flat bottom wall 62 of the potty seat 20, to make contact with a top surface 66 of the base 26. A light bulb assembly 68 is mounted in the flat bottom wall 62 of the potty seat 20. A fiber optic cable 70 is mounted to a lower surface of the convex top wall 60 of the potty seat 20, to distribute light from the light bulb assembly 68 when the light bulb assembly 68 is illuminated. A contact post 72 extends downwardly from the light bulb assembly 68.

The transparent material 58 of the potty seat 20 is impregnated with a phosphorescent substance 74 that will absorb light energy from the light bulb assembly 68 therein and additionally from daytime natural light and other artificial light to keep the phosphorescent substance 74 charged. It will glow in the dark, until the potty seat 20 is used to recharge the phosphorescent substance 74 again.

A battery 76 is carried within a compartment 78 within the armrest 34 of the potty toilet 12. A contact member 80 is mounted into the base 26 with a portion of the contact member 80 extending into the opening 28 of the base 26 under the contact post 72. An electrical wire 82 extends between the battery 76 and the contact member 80. When the toddler sits upon the potty seat 20, the weight of the toddler will compress the pad 64, causing the contact post 72 to engage with the contact member 80, thereby completing an electrical circuit between the light bulb assembly 68 and the battery 76.

The musical sound assemblage 24 consists of another compressible resilient pad 64 mounted to the flat bottom wall 62 of the potty seat 20, to make contact with the top surface 66 of the base 26. A music box 84 is carried within a compartment 86 within the armrest 36 of the potty toilet 12. A contact post 88 extends downwardly from the flat bottom wall 62 of the potty seat 20.

A battery 90 is carried within a compartment 92 within the armrest 36 of the potty toilet 12 under the music box compartment 86. A contact member 94 is mounted into the base 26 with a portion of the contact member 94 extending into the opening 28 of the base 26 under the contact post 88. An electrical wire 96 extends between the battery 90, the music box 84 and the contact member 94. When the toddler sits upon the potty seat 20, the weight of the toddler will compress the pad 64, causing the contact post 88 to engage with the contact member 94, thereby completing an electrical circuit between the music box 84 and the battery 90.

A door 98 is hinged to the battery compartment 78. A snap lock 100 is on the door 98. When the door 98 is closed and the snap lock 100 is engaged, the door 98 will press the battery 76 into position within the battery compartment 78 to make contact with the electrical circuit to the light bulb assembly 68. A door 102 is hinged to the battery compartment 92. A snap lock 104 is on the door 102. When the door 102 is closed and the snap lock 104 is engaged, the door 102 will press the battery 90 into position within the battery compartment 92, to make contact with the electrical circuit to the music box 84. A door 106 is hinged to the music box compartment 86, so that a person can have access to the music box 84 therein.

LIST OF REFERENCE NUMBERS

10 potty training device
12 potty toilet of 10
14 toilet seat of 18
16 bowl of 18
18 standard toilet
20 potty seat of 10
22 illuminating facility of 10 for 20
24 musical sound assemblage of 10 in 12
26 base of 12
28 horizontally disposed opening in 26
30 convex portion of 32
32 bottom surface of 26
34 first upright armrest of 12
36 second upright armrest of 12
38 upright low backrest of 12
40 side leg of 42
42 attaching components for 40
44 groove in 32
46 tongue on 48

48 top surface of 40
50 collection basin of 12
52 connecting structure on 20
54 annular top lip on 50 for 52
56 L-shaped bracket for 52
58 transparent material of 20
60 convex top wall of 20
62 flat bottom wall of 20
64 compressible resilient pad of 22 and 24
66 top surface of 26
68 light bulb assembly of 22
70 fiber optic cable of 22
72 contact post of 22
74 phosphorescent substance in 58
76 battery in 78
78 battery compartment in 34
80 contact member of 22
82 electrical wire between 76 and 80
84 music box of 24
86 music box compartment in 36
88 contact post of 24
90 battery in 92
92 battery compartment in 36
94 contact member of 24
96 electrical wire between 84, 90 and 94
98 door to 78
100 snap lock on 98
102 door to 92
104 snap lock on 102
106 door to 86

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A potty training device which comprises:

a) a potty toilet so constructed that it can be positioned upon a toilet seat on a bowl of a standard toilet, said potty toilet including:

i) a base having a horizontally disposed opening and a convex portion on a bottom surface about said opening, so that said convex portion of said base can snugly fit upon the toilet seat, with said polly seat placed on said base;

ii) a pair of upright armrests located on opposite sides of said polly seat and supported by said base;

iii) an upright low backrest extending between said armrests;

iv) a pair of side legs; and v) means for attaching said side legs in a removable manner to said bottom surface of said base on opposite sides of said opening, so that said potty toilet can stand alone upon a floor, said attaching means including a pair of grooves formed on said bottom surface on opposite sides of said opening, and a tongue formed on a top surface of each of said side legs so that each said tongue can longitudinally slide into each said groove;

b) a potty seat horizontally disposed on said potty toilet;

c) means in said potty toilet, for illuminating said potty seat, when a toddler sits upon said potty seat; and d) means in said potty toilet, for producing musical sounds when the toddler sits upon said potty seat.

2. A potty training device as recited in claim 1, wherein said base, said armrests and said low backrest are integral, so as to form one complete unit.

3. A potty training device as recited in claim 2, wherein said potty toilet further includes:

a) a collection basin; and b) means for connecting said collection basin in a removable manner to an underside of said potty seat, so that when said potty seat is in place on said base, the toddler sitting upon said potty seat can deposit excrement into said collection basin.

4. A potty training device as recited in claim 3, wherein said connecting means includes:

a) said collection basin having an annular top lip thereabout; and b) a pair of L-shaped brackets affixed to opposite sides at said underside of said potty seat, to engage with said annular top lip of said collection basin.

5. A potty training device as recited in claim 4, wherein said illuminating means includes:

a) said potty seat being hollow, fabricated out of a transparent material and having a convex top wall and a flat bottom wall;

b) a compressible resilient pad mounted to said flat bottom wall of said potty seat, to make contact with a top surface of said base;

c) a light bulb assembly mounted in said flat bottom wall of said potty seat;

d) a fiber optic cable mounted to a lower surface of said convex top wall of said potty seat, to distribute light from said light bulb assembly when said light bulb assembly is illuminated;

e) a contact post extending downwardly from said light bulb assembly;

f) a battery carried within a compartment within one said armrest of said potty toilet;

g) a contact member mounted into said base with a portion of said contact member extending into said opening of said base under said contact post; and h) an electrical wire extending between said battery and said contact member, so that when the toddler sits upon said potty seat, the weight of the toddler will compress said pad, causing said contact post to engage with said contact member, thereby completing an electrical circuit between said light bulb assembly and said battery.

6. A potty training device as recited in claim 5, wherein said transparent material of said potty seat is impregnated with a phosphorescent substance that will absorb light energy from said light bulb assembly therein and additionally from daytime natural light and other artificial light to keep said phosphorescent substance charged so that it will glow in the dark, until said potty seat is used to recharge said phosphorescent substance again.

7. A potty training device as recited in claim 6, wherein said musical sound means includes:

a) a compressible resilient pad mounted to said flat bottom wall of said potty seat, to make contact with a top surface of said base;

b) a music box carried within a compartment within one said armrest of said potty toilet;

c) a contact post extending downwardly from said flat bottom wall of said potty seat;

d) a battery carried within a compartment within one said armrest of said potty toilet under said music box compartment;

e) a contact member mounted into said base with a portion of said contact member extending into said opening of said base under said contact post; and f) an electrical wire extending between said battery, said music box and said contact member, so that when the toddler sits upon said potty seat, the weight of the toddler will compress said pad, causing said contact post to engage with said contact member, thereby completing an electrical circuit between said music box and said battery.

8. A potty training device as recited in claim 7, further including:

a) a door hinged to said battery compartment; and b) a snap lock on said door, so that when said door is closed and said snap lock is engaged, said door will press said battery into position within said battery compartment to make contact with said electrical circuit to said light bulb assembly.

9. A potty training device as recited in claim 8, further including:

a) a door hinged to said battery compartment; and b) a snap lock on said door, so that when said door is closed and said snap lock is engaged, said door will press said battery into position within said battery compartment to make contact with said electrical circuit to said music box.

10. A potty training device as recited in claim 9, further including a door hinged to said music box compartment, so that a person can have access to said music box therein.

11. A potty training device as recited in claim 1, wherein said potty toilet further includes:

a) a collection basin; and b) means for connecting said collection basin in a removable manner to an underside of said potty seat, so that when said potty seat is in place on said base, the toddler sitting upon said potty seat can deposit excrement into said collection basin.

12. A potty training device as recited in claim 11, wherein said connecting means includes:

a) said collection basin having an annular top lip thereabout; and b) a pair of L-shaped brackets affixed to opposite sides at said underside of said potty seat, to engage with said annular top lip of said collection basin.

13. A potty training device which comprises:

a) a potty toilet so constructed that it can be positioned upon a toilet seat on a bowl of a standard toilet, said potty toilet including:

i) a base having a horizontally disposed opening and a convex portion on a bottom surface about said opening, so that said convex portion of said base can snugly fit upon the toilet seat, with said potty seat placed on said base;

ii) a pair of upright armrests located on opposite sides of said potty seat and supported by said base; and iii) an upright low backrest extending between said armrests;

b) a potty seat horizontally disposed on said potty toilet;

c) means in said potty toilet for illuminating said potty seat, when a toddler sits upon said potty seat, wherein said illuminating means includes:

i) said potty seat being hollow, fabricated out of a transparent material and having a convex top wall and a flat bottom wall;

ii) a compressible resilient pad mounted to said flat bottom wall of said pot-by seat, to make contact with a top surface of said base;

iii) a light bulb assembly mounted in said flat bottom wall of said potty seat;

iv) a fiber optic cable mounted to a lower surface of said convex top wall of said potty seat, to distribute light from said light bulb assembly when said light bulb assembly is illuminated;

v) a contact post extending downwardly from said light bulb assembly;

vi) a battery carried within a compartment within one said armrest of said potty toilet;

vii) a contact member mounted into said base with a portion of said contact member extending into said opening of said base under said contact post; and viii) an electrical wire extending between said battery and said contact member, so that when the toddler sits upon said potty seat, the weight of the toddler will compress said pad, causing said contact post to engage with said contact member, thereby completing an electrical circuit between said light bulb assembly and said battery; and d) means in said potty toilet, for producing musical sounds when the toddler sits upon said potty seat.

14. A potty training device as recited in claim 13, wherein said transparent material of said potty seat is impregnated with a phosphorescent substance that will absorb light energy from said light bulb assembly therein and additionally from daytime natural light and other artificial light to keep said phosphorescent substance charged so that it will glow in the dark, until said potty seat is used to recharge said phosphorescent substance again.

15. A potty training device as recited in claim 13, further including:

a) a door hinged to said battery compartment; and b) a snap lock on said door, so that when said door is closed and said snap lock is engaged, said door will press said battery into position within said battery compartment to make contact with said electrical circuit to said light bulb assembly.

16. A potty training device which comprises:

a) a potty toilet so constructed that it can be positioned upon a toilet seat on a bowl of a standard toilet, said polly toilet including:

i) a base having a horizontally disposed opening and a convex portion on a bottom surface about said opening, so that said convex portion of said base can snugly fit upon the toilet seat, with said potty seat placed on said base;

ii) a pair of upright armrests located on opposite sides of said potty seat and supported by said base; and iii) an upright low backrest extending between said armrests:

b) a potty seat horizontally disposed on said potty toilet;

means in said potty toilet, for illuminating said potty seat, when a toddler sits upon said potty seat; and d) means in said potty toilet, for producing musical sounds when the toddler sits upon said potty seat, wherein said musical sound means includes:

a) a compressible resilient pad mounted to said flat bottom wall of said polly seat, to make contact with a top surface of said base;

b) a music box carried within a compartment within one said armrest of said potty toilet;

c) a contact post extending downwardly from said flat bottom wall of said potty seat;

d) a battery carried within a compartment within one said armrest of said potty toilet under said music box compartment;

e) a contact member mounted into said base with a portion of said contact member extending into said opening of said base under said contact post; and f) an electrical wire extending between said battery, said music box and said contact member, so that when the toddler sits upon said potty seat, the weight of the toddler will compress said pad, causing said contact post to engage with said contact member, thereby completing an electrical circuit between said music box and said battery.

17. A potty training device as recited in claim 16, further including:

a) a door hinged to said battery compartment; and b) a snap lock on said door, so that when said door is closed and said snap lock is engaged, said door will press said battery into position within said battery compartment to make contact with said electrical circuit to said music box.

18. A potty training device as recited in claim 16, further including a door hinged to said music box compartment, so that a person can have access to said music box therein.

* * * * *